US006325602B1

(12) United States Patent
Rademacher

(10) Patent No.: US 6,325,602 B1
(45) Date of Patent: Dec. 4, 2001

(54) AUTOMOTIVE VACUUM PUMP

(76) Inventor: John J. Rademacher, No. 64, 2275 W. 25th St., San Pedro, CA (US) 90732

( * ) Notice: Subject to any disclaimer, the term of this patent is extended or adjusted under 35 U.S.C. 154(b) by 0 days.

(21) Appl. No.: 09/401,708

(22) Filed: Sep. 23, 1999

(51) Int. Cl.[7] ..... F04C 18/344; F04C 29/00

(52) U.S. Cl. ..... 418/81; 418/104; 418/259; 417/361

(58) Field of Search ..... 418/81, 104, 259, 418/266; 417/361

(56) References Cited

U.S. PATENT DOCUMENTS

| | | | | |
|---|---|---|---|---|
| 462,708 | * | 11/1891 | Hochhausen | 418/259 |
| 845,114 | * | 2/1907 | Palmer | 418/81 |
| 888,779 | * | 5/1908 | Berrenberg | 418/259 |
| 3,183,843 | * | 5/1965 | Cockburn | 418/266 |
| 4,231,728 | * | 11/1980 | Hertell | 418/81 |
| 4,437,821 | * | 3/1984 | Ogawa | 418/104 |
| 4,557,678 | * | 12/1985 | Nishimura | 418/259 |
| 4,834,634 | * | 5/1989 | Ono | 418/104 |
| 5,705,870 | * | 1/1998 | Thomsen et al. | 417/361 |
| 5,954,489 | * | 9/1999 | Kinoshita | 418/259 |

FOREIGN PATENT DOCUMENTS

| | | | | |
|---|---|---|---|---|
| 60-261990 | * | 12/1985 | (JP) | 418/259 |
| 1-170783 | * | 7/1989 | (JP) | 418/104 |
| 4-269387 | * | 9/1992 | (JP) | 418/259 |
| 1008489 | * | 3/1983 | (RU) | 418/266 |

* cited by examiner

*Primary Examiner*—John J. Vrablik
(74) *Attorney, Agent, or Firm*—Curtis L. Harrington

(57) ABSTRACT

A light-weight vacuum pump has a multi-wiper member circular wiper member support and impeller which is eccentrically mounted within a pump housing. The multi wiper member circular support carries from about five to nine wiper members each mounted within a slot extending substantially the length of the support, with each wiper member being centrifically urged outwardly to wipingly engage an inner surface of a round or elliptical walled pump housing. Eccentric action enables the wiper members to be extended to create a large space between adjacent wiper members as an inlet is passed. As the wiper members pass by the inlet, the acentric cylindrical wall of the pump housing begins to compress the wiper members into the support, thereby reducing the space between adjacent wiper members in a compressive manner. The wiper member support further carries an added volume pocket between adjacent pairs of wiper members in order to (1) take in more air volume, and (2) create a less severe compression per inter wiper member volume compressed. This configuration can deliver high volumes of evacuated dump air and yet create significantly high vacuum at higher speeds of operation.

16 Claims, 6 Drawing Sheets

AUTOMOTIVE VACUUM PUMP

FIELD OF THE INVENTION

The present invention relates to the field of high performance automotive equipment and more specifically to an automotive vacuum pump having significant volume elimination and pressure reduction capability and which is used to increase horsepower, and in which is overcome the lubrication problems caused from operating a continuous vacuum chamber.

BACKGROUND OF THE INVENTION

High performance combustion engines attempt to utilize every reasonable advantage in extracting more utilizable horsepower and torque from the engine so long as the compromise in power or weight to achieve that horsepower is not excessive. Techniques to increase horsepower, for example, include reducing the exhaust pressure drop by either eliminating the muffler or tuning the exhaust port so that the pulsating exit of the exhaust gasses do not work to build the pressure drop. Superchargers and turbo chargers are another method of increasing horsepower by increasing the pressure into the combustion chambers, to add more fuel per stroke, and to extract more power upon each ignitive explosion.

In internal combustion engines, the piston downstroke transfers power from the ignitive explosion. The pressure of the explosion acts against the piston rod to turn the crank shaft, but also acts against the atmospheric or higher pressure in the crank case. Atmospheric pressure is normally expected to exist in the crank case, but slightly higher pressures can and do exist because the wiping sealing between the piston rings and combustion chamber are not perfect.

Elimination of even the atmospheric pressure in the crank case would eliminate by at least 14.696 pounds per square inch, the force opposing the power stroke of the piston. In addition, it would assist the piston's travel toward the crank shaft during the intake stroke when combustion air and fuel are being drawn into the combustion chamber. Admittedly, the piston would be working to compress the combustion chamber during the compression stroke and working to expel the exhaust gasses on the exhaust stroke against the reverse pull of a vacuum, but the greater criticality in withdrawing maximum power during the brief power stroke, as well as the advantage in drawing in combustants, significantly overcomes any compensation in either of the other two strokes where the piston would act against a vacuum developed in the crank case.

A vacuum in the crankcase can add, on average about 15% to the horsepower rating of the engine, depending upon the level of vacuum attainable. However, because the engine is not a perfectly sealed environment, a vacuum in the crank case is not maintainable as a static, pre-set condition. A vacuum draws in gasses from around the piston rings, as well as through the crank shaft and other imperfectly sealed surfaces between the crank case and available gasses which would defeat a pre-set vacuum.

In addition, the use of a conventional vacuum pump to try to achieve high vacuum is unworkable for several reasons. First, most of the positive displacement high vacuum pumps cannot provide a sufficient level expelled volume to be of sufficient use in keeping up with the crank case pressure or volume requirements. Second, the typical piston vacuum pump consumes significant energy since it too has a piston which is withdrawn against atmospheric pressure, only to compressively eliminate only a small amount of waste air at high vacuum for each stroke. Thirdly, the size and weight of a conventional vacuum unit is also prohibitive. One of the contributing factors to weight is the need to provide both sealing and lubricative bearing support of the shaft of the vacuum pump. Where a vacuum is had on one side of a shaft, the vacuum tends to draw lubricant and surrounding air and moisture into the vacuum pump. Repeated lubrication only results in lubricant contaminating the internals of the pump. Repeated lubrication in the high performance automotive environment is simply not a reasonable option.

What is therefore needed is a very light weight source of vacuum, which can move relatively high volumes of air from an evacuated crank shaft, but without loss of efficiency. The needed source of vacuum should also be relatively free of lubrication troubles, especially the problem of sucking the lubricant into the pump to leave the moving parts un-lubricated.

SUMMARY OF THE INVENTION

The light-weight vacuum pump of the present invention includes a multi-wiper member circular wiper member support and impeller which is eccentrically mounted within a pump housing, preferably by displacement of the impeller along a line at right angles to the flow of air in order to make the vacuum pump bi-directional, such that it can be mounted on either side of an engine by simply turning the pump about a line extending between the inlet and the outlet. The multi wiper member circular support carries from about five wiper members to about nine wiper members each mounted within a slot extending substantially the length of the support, with each wiper member being centrifically urged outwardly to wipingly engage an inner cylindrical surface of a pump housing. The acentric mounting of the circular support enables the wiper members to be extended to create a large space between adjacent wiper members as the inlet is passed. In the alternative, the inner cylindrical surface can be modified to be an ellipse. As the wiper members pass by the inlet, the acentric cylindrical wall of the pump housing begins to compress the wiper members into the support, thereby reducing the space between adjacent wiper members in a compressive manner. The inner support further carries an added volume pocket between adjacent pairs of wiper members in order to (1) take in more air volume, and (2) create a less severe compression per inter wiper member volume compressed. The added volume pocket eases the energy required per volume of compression by providing a space to limit the rise in pressure. This configuration can deliver high volumes of evacuated dump air and yet create significantly high vacuum at higher speeds of operation. The support rotates on a shaft deriving mechanical energy by drive belt from the engine. The support and shaft are isolated by use of a ball bearing, "U" cross sectionally shaped seal outwardly disposed, followed by a main shaft seal. A shallow pocket having a depth of between five and fifty thousandths of an inch, and having a width of about one centimeter, formed on the inside of the housing about the main shaft seal to reduce frictional resistance to centrifical movement of the vanes, as well as to reduce the frictional area of the vanes pressure against the vane slots in the main body in which they reside.

BRIEF DESCRIPTION OF THE DRAWINGS

The invention, its configuration, and its construction will be further depicted in the following detailed description, taken in conjunction with the accompanying drawings in which.

DETAILED DESCRIPTION OF THE PREFERRED EMBODIMENT

Figure 1:
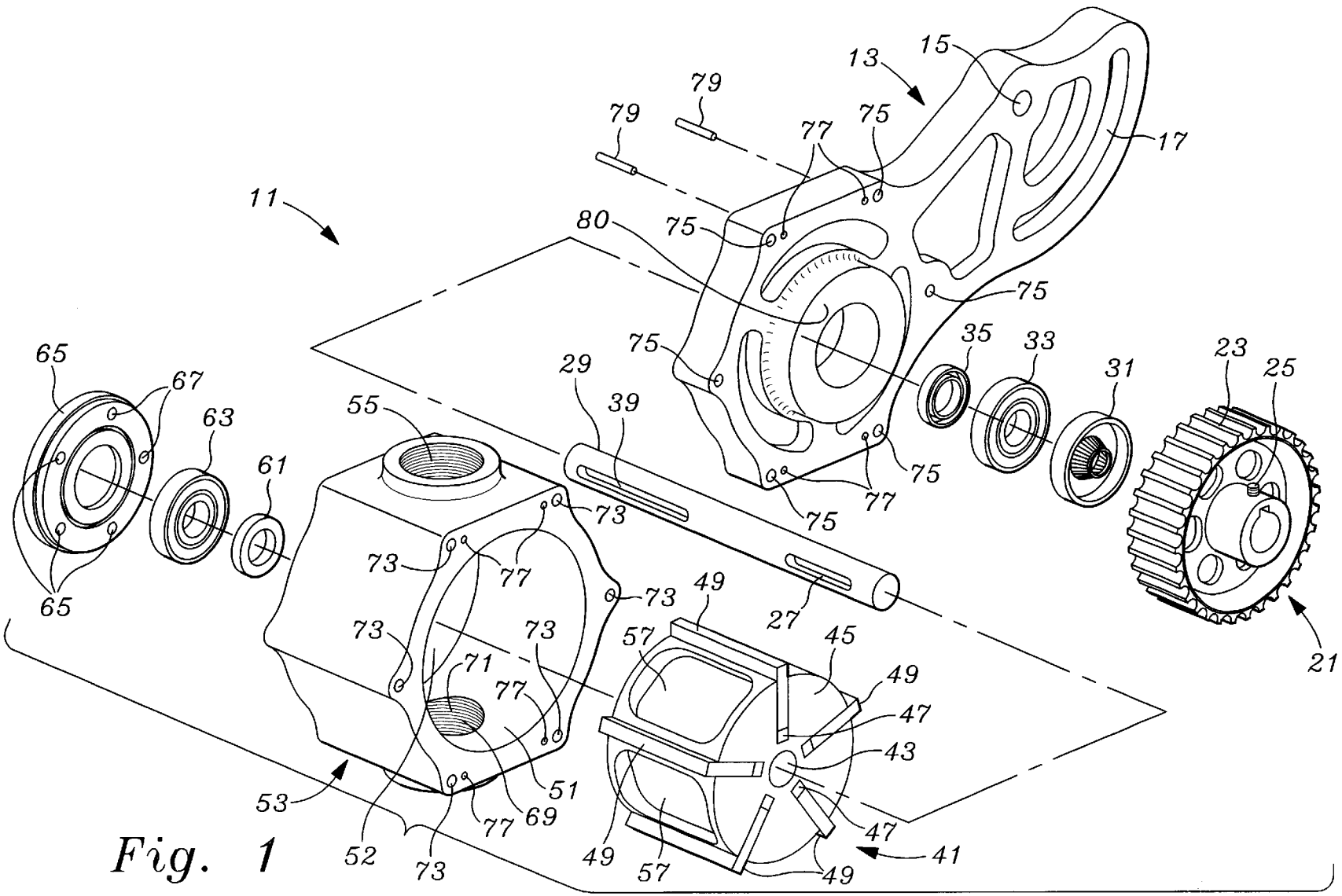
FIG. 1 is an exploded view of the vacuum pump of the invention illustrating the components, bearing and seals and drive wheel.

The invention will be best described with reference to FIG. 1 which illustrates an exploded perspective view of a vacuum pump 11. At the upper right of the FIG. 1 is an integrated mounting bracket and end plate drive support 13, hereinafter referred to as a support cover. A non supporting cover will also be illustrated. The support cover contains a bore 15 for mounting on a vehicle, and a radius slot 17 for use in conjunction with the bore 15 for using bore 15 to pivot around a bolt (not shown) and to lock the plate drive support 13 in a position to derive adequate mechanical drive force.

To the right of the plate drive support 13 is a drive wheel 21. The drive wheel 21 shown has rectangular ribs 23 for a positive grip on a drive belt, and includes a hexagonal screw 25 for positive registration within a first slot 27 on a drive shaft 29. An main shaft seal 31 is located adjacent the drive wheel 21, and a closely fitting roller bearing 33 is located next to the main shaft seal 31. Adjacent the roller bearing 33, a polymer sealing ring 35 fits within a chamfer 37 adjacent a closely fitting shaft aperture 39.

Polymer sealing ring 35 has a continuous circular shape, each portion of the circle having a cross sectional "U" shape with the shape of the "U" disposed toward the drive wheel 21. Force developed on the vacuum side of the support cover 13 pulls the polymer sealing ring 35 inward, but the inner wall of the ring simply seals tighter against the shaft 29. One polymer sealing ring 35 includes an outer wall and bottom of the "U" shape made of relatively hardened material, even where the inner wall of polymer sealing ring 35 adjacent the shaft 29 is of relatively soft material. The chamfer 37 helps stabilize the polymer sealing ring and provide sufficient support so that the inner wall of the polymer sealing ring 35 will maintain its shape and area coverage against the shaft 29.

In the line of connection, the shaft 29 is shown with a second, longer slot 39 on which to register a support 41. Support 41 includes a central bore 43. The support has a main body 45 having a series of radially disposed slots 47 each supporting a wiper member 49. Within each of the slots 47, which can be seen to the extent that each slot's 47 a wiper member 49 is preferably urged radially outwardly by centrifical force from the rotational motion of the main body 45, no spring member may be necessary. In the case where centrifical force is used, the mass of the wiper members 49 will have to be sufficient to extend the wiper members 49 and apply enough wiping pressure to perform the pumping action and the contact of the side edges of the wiper members 49 will be sufficiently minimized to enable rapid deployment. The support 41 is mounted to one side of center within a cylindrical surface 51 within a pump housing 53. Cylindrical surface 51 lies adjacent to a rear smooth wall 52. An elliptical surface can be used in place of a cylindrical surface, particularly where the characteristics of the vacuum pump II are to be modified for particular characteristics of different engines with which it is used. In the case of a cylindrical surface with a completely circular side wall, as is shown in FIG. 1, an off center mounting of the main body 45 causes each of the wiper members 49 to expand to form a larger opening between adjacent wiper members 49 adjacent an opening 55, (assuming a that the movement of the main body 45 past the opening is such that the spaces between the wiper members is expanding), and to retract as the wiper members pass by a closer section of the cylindrical surface 51. With an elliptical shaped surface 51, the main body 45 would still be relatively cylindrical, having a circular radial sweep, and its mounting would not be as precisely describable as position relative to a radial center, but the position would likely be on a chord between the two foci of the ellipse.

As the support 41 turns, each of the wiper members moves into and out of its slot 47 as the end edges of the wiper members 49 follow the cylindrical surface 51. In addition, in the main body 45, between adjacent the radially disposed slots 47 are a series of capacity pockets 57. These capacity pockets 57 reduce the compression ratio and increase the volume flow rate. This provides a flow rate and pressure which is both more appropriate to the amount of volume to be removed from an internal combustion engine, as well as to form a vacuum pump 11 which is more responsive to speed.

For a given vacuum within an internal combustion engine, the volume of gasses which need to be evacuated is proportional to the speed of the engine. The vacuum pump 11 of the invention operates faster as the engine speed increases since the drive wheel 21 turns in response to engine speed.

At the rear of the pump housing a second polymer sealing ring 61 is seen, but its cross sectional cup shaped opening is not seen as it faces away from the pump housing 53. Also seen is a second closely fitting roller bearing 63. An end cap 65 contains a series of apertures 67 for attachment to the pump housing 53. The pump housing 51 has a lower opening 69. Both the lower opening 69 and the upper opening 55 have internal threads 71 for attachment to flow conduit or tubing for both connection to an internal combustion engine and for providing a dump away from the vacuum pump 11 where desired. By offsetting the main body 45 along a line generally between the upper opening 55 and the lower opening 69, the vacuum pump 11 becomes reversible such that it can be mounted on either side of the engine and still perform its function.

Also seen on the pump housing 53 are a series of threaded bores 73 which align with a series of open bores 75 to affix the support cover 13 to the pump housing 53. In addition, both the support cover 13 and the pump housing 53 contain a series of aligning pin registry bores 77 which are utilizable with a series of registry pins 79 to make certain that the support cover 13 to the pump housing 53 are aligned. An outwardly extending boss 80 is also seen which lends further stability to the support cover 13.

Figure 2:
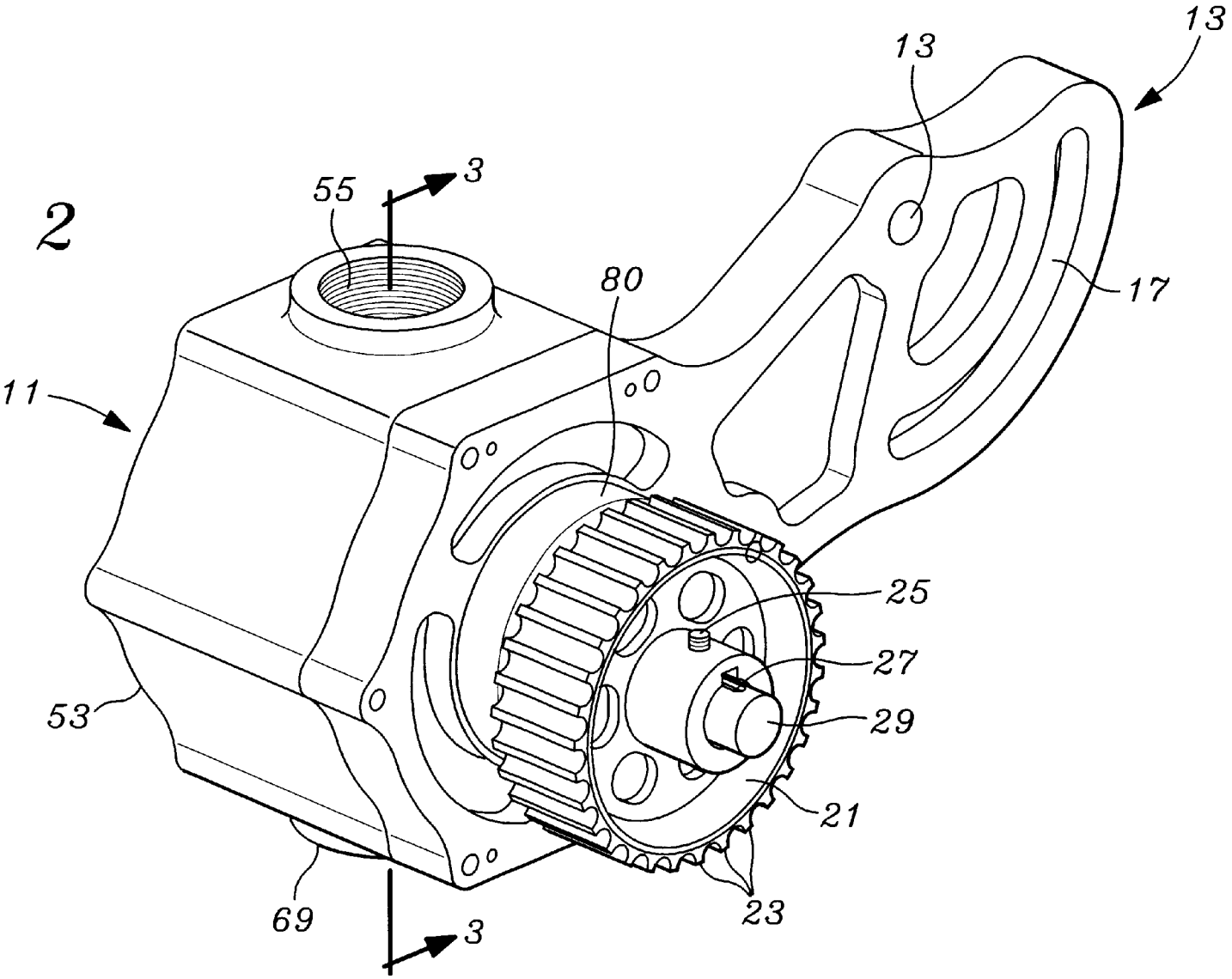
FIG. 2 is a perspective view of the vacuum pump of FIG. 1 in assembled view.

Referring to FIG. 2, the assembled vacuum pump is shown. The hexagonal screw 25 is engaging the first slot 27 to register the drive wheel 21. In the configuration of FIG. 2, the vacuum pump 11 need only be mounted via the bore 15 and radius slot 17, and engaged within a loop of a drive belt to be operational. Depending on the direction of turn, either the opening 55 or the opening 69 is connected in communication with the crank case of an internal combustion engine. Running the engine lowers the internal pressure and in increases the efficiency. It has been found that the vacuum pump 11 yields from 12–15% efficiency increase, depending upon the internal combustion engine to which the vacuum pump 11 is operably attached. A vacuum of twenty six inches of water can be maintained at a static, non flowing condition while vacuum pump 11 consumes four horsepower. When engaged with an internal combustion engine, and as flow ensues from the static vacuum condition, a typical racing engine experiences an additional net 31 horsepower (after subtraction of the operating horsepower) when a vacuum of nineteen inches of water is maintained, and net 63 horsepower when a vacuum of twenty two inches is maintained.

Figure 3:
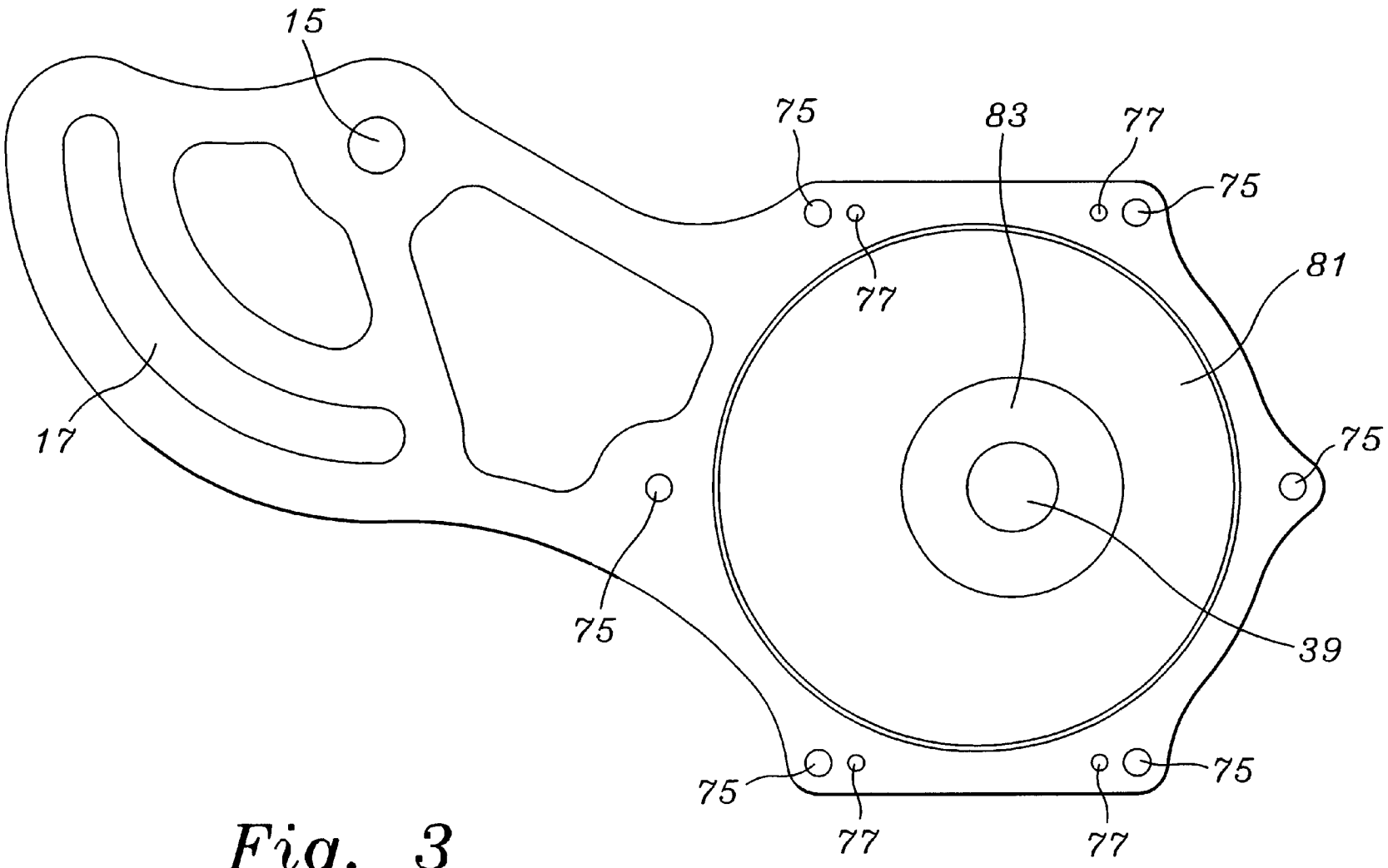
FIG. 3 is a rear view of the support cover seen in FIG. 1 and illustrating the flat surface which lies adjacent the main body which supports the wiper members.
Figure 4:
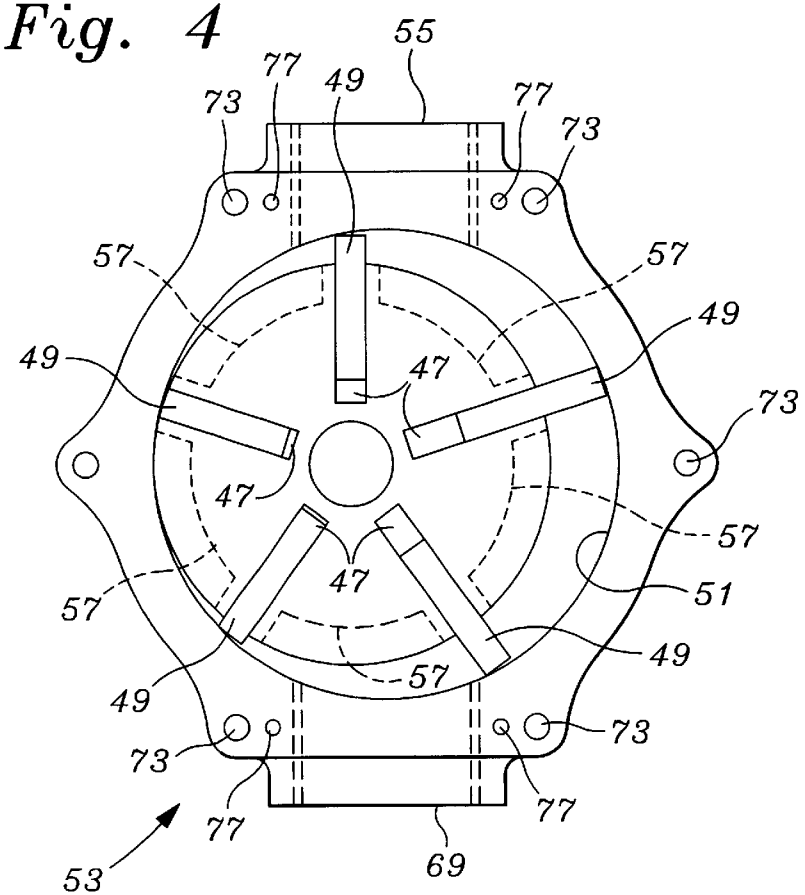
FIG. 4 is a plan view of the main body within the pump housing and illustrating the radially outward movement of the wipers against the cylindrical surface of the inside of the pump housing.

Referring to FIG. 3, a view of the rear side of the support cover 13 illustrates a circular flat area 81 into which the shaft aperture 39 is formed. Also seen is a shallow clearance pocket 83 having a depth of between five and fifty thousandths of an inch, and having a width of about one centimeter, formed on the inside of the housing about the main shaft seal to reduce frictional resistance to centrifical movement of the vanes or wiper members 49, as well as to reduce the frictional area of the wiper members 49 against the vane slots 47 in the main body 45 in which they reside. Referring to FIG. 4, a plan view of the pump housing 53 is seen with the support 41 in rotational position. As can be seen, the wiper members 49 extend from the main body 45 and are urged out by each one by its own centrifical force when the main body 45 is spinning. Since the sides of the wiper members 49 and the sides of the main body are flat and close fitting, no further sealing is needed, and the shallow clearance pocket 83 which provides a reduction in friction does not provide a break in the vacuum pressure or vane 49 flowing pressure because a more severe seal is had between the circular flat area 81 and both of the flat end wall of the main body 45 and side edges of the wiper members 49. The displacement of the shaft 29 from center of the cylindrical surface 51 is to one side of a line extending between the opening 55 and 69. As such, the direction of rotation will determine whether opening 55 is intake or exhaust, with opening 69 being exhaust or intake, respectively. Where the displacement of the shaft 29 from center of the cylindrical surface 51 is to one side of a line extending between the opening 55 and 69, and brought toward one of the openings 55 and 69, the compression and evacuation efficiency will change and forward and reverse completely equivalent action will not be present. Where the shaft 29 is brought closer to opening, 69 for example, the compression ratio for pumping is increased, and for evacuating is decreased. If the other opening 55 is used, the evacuation ratio is increased, but the pumping ratio is decreased, again assuming shaft 29 is brought closer to opening 69. In any event, the needs of a specific 5 engine, in terms of a composite profile of its exhaust volume and achievable minimum pressure can be more closely approached or met by selecting the position of the shaft 29 with respect to the cylindrical surface 51 in terms of how far off center it is, as well as how close it is to one of the openings 55 or 69.

In addition, the pump housing 53 is shown with the openings 55 and 69 oppositely oriented, in other words 180° apart with respect to the cylindrical center of the cylindrical surface 51. This need not necessarily be the case. With regard to the cylindrical center of the cylindrical surface 51, both the shape of the openings and their center positions can be changed or differed with respect to each other. In addition, other changes to the shape and volume of the pockets 57 can also be made. Changes to the volume and shape of the pockets 57 can be done in conjunction with other changes to the vacuum pump 11 previously mentioned. Thus for different applications, different physical configurations of the vacuum pump 11 can be had to maximize utility for a given application.

Figure 5:
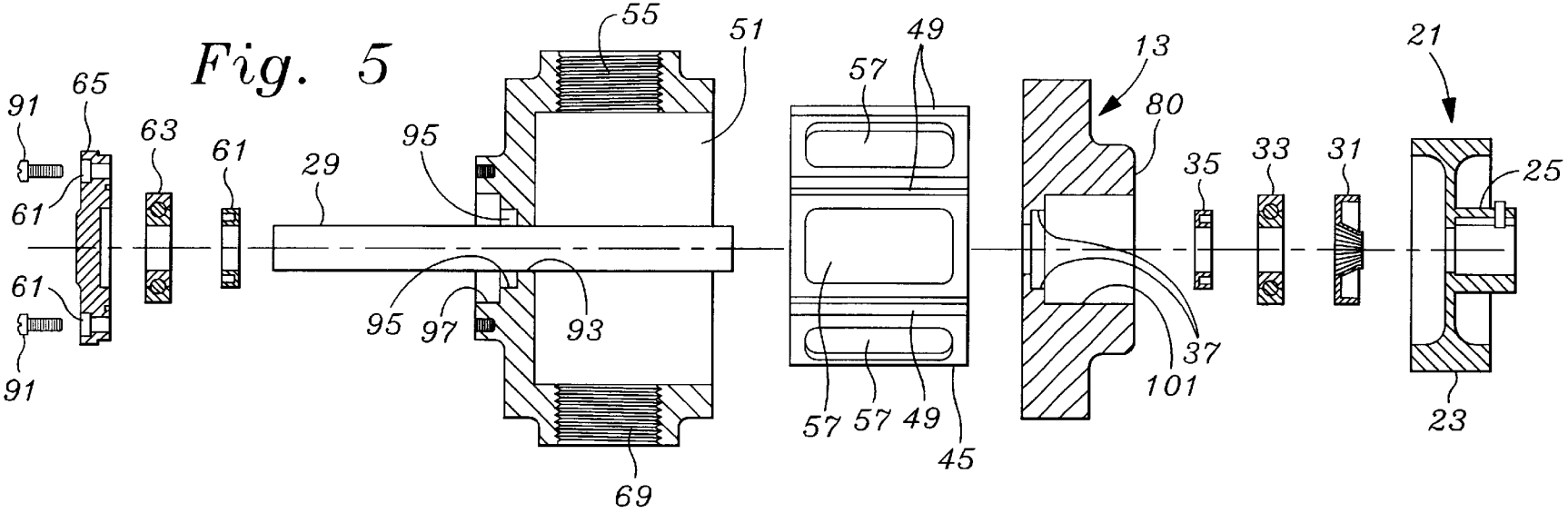
FIG. 5 is sectional exploded view illustrating the component parts seen in FIGS. 1–4.

FIG. 5 is a sectional exploded view illustrating the component parts seen in FIGS. 1–4. At the left of the FIG. 5, bolts 91 are used to secure a sealing end cap 65 to the pump housing 53. The end cap 65, as can be seen, provides a covering and further sealing to help further block air and dirt from being drawn into the housing 53, and to help buttress the end of the shaft 29 so that a limit is had should a force act to move the shaft toward end cap 65. It is expected that on normal operation of the vacuum pump 11 that no friction between the end of the shaft 29 and inside of the end cap 65 will be had.

Figure 6:
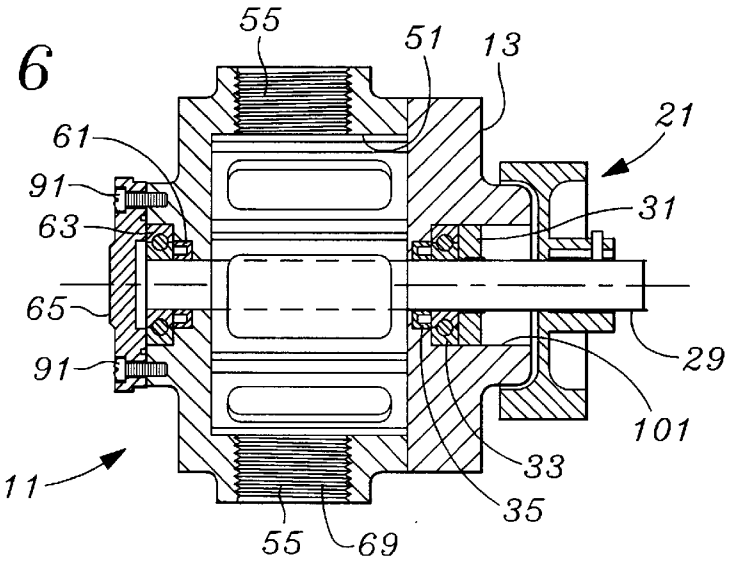
FIG. 6 is a sectional view of the assembled vacuum pump seen in FIG. 5 and illustrating the close fitting relationship of the component parts thereof.

Features not seen in the other Figures are now seen in FIG. 5. An aperture 93 closely surrounds and admits the shaft 29. A small chamfer 95 facilitates the fit of second polymer sealing ring 61. A large groove 97 facilitates the fit of the second closely fitting roller bearing 63. To the right of the main body 45, the support cover 13 is shown with a large circular depression 101, which is adjacent to the chamfer 37. To the right is shown the polymer sealing ring 35 which fits into the chamfer 37, as well as the closely fitting roller bearing 33 which fits over the polymer sealing ring 35, and the main shaft seal 31 which fits adjacent the closely fitting roller bearing 33. Other features of FIG. 5 were generally seen in the other Figures, but FIG. 5 better illustrates how the bearing and sealing structures fit closely together. FIG. 6 illustrates a sectional view of the assembled pump 11 from a same perspective as that of FIG. 5, but with the interfitting of the related structures clearly shown.

Figure 7:
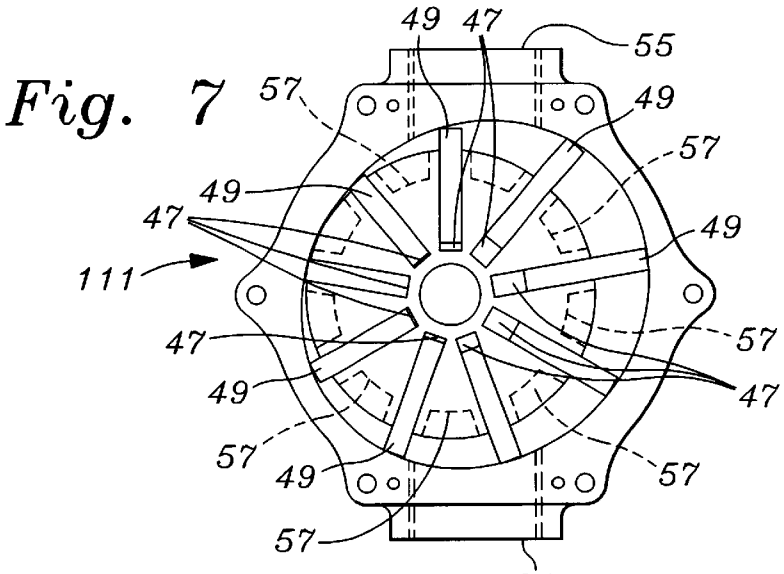
FIG. 7 is a plan view of the main body of a pump having nine wipers and illustrating the radially outward movement of the wipers against the cylindrical surface of the inside of the pump housing.

FIG. 7 is a plan view of the main body of a pump 11 having nine wipers 49 and illustrating the radially outward movement of the wipers against the cylindrical surface of the inside of the pump housing 53.

Figure 8:
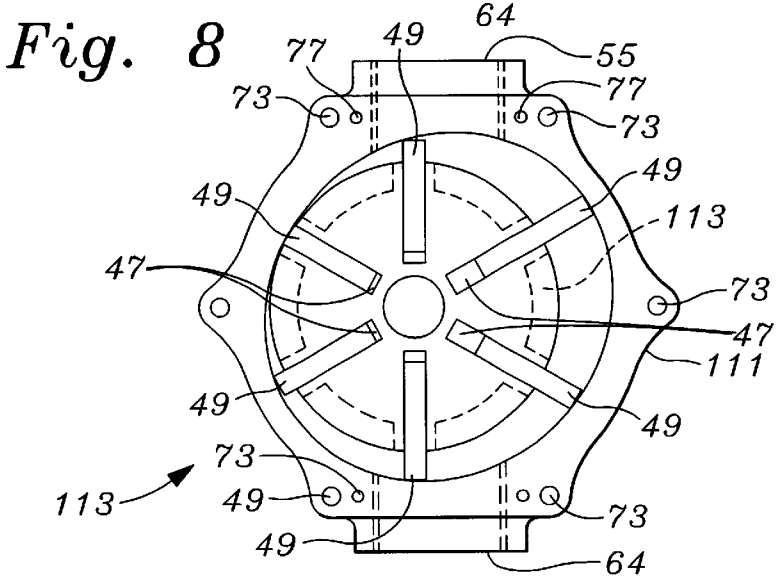
FIG. 8 is a plan view of the main body of a pump having six wipers and illustrating the radially outward movement of the wipers against the cylindrical surface of the inside of the pump housing.

FIG. 8 is a plan view of the main body of a pump 113 having six wipers and illustrating the radially outward movement of the wipers against the cylindrical surface of the inside of the pump housing 53.

Figure 9:
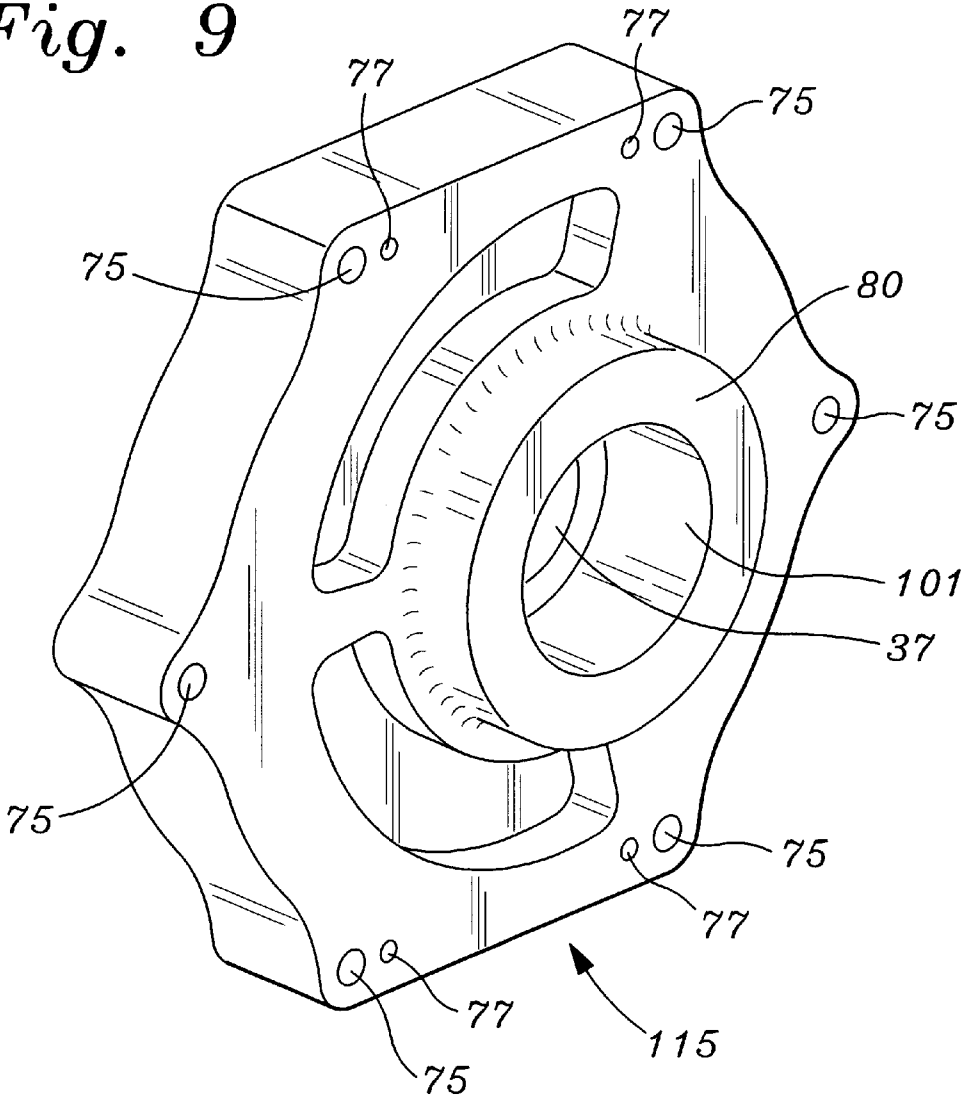
FIG. 9 is a plan view of an end cover without a support portion.

Referring to FIG. 9, a perspective view of a cover 15 having all of the features of the cover support 13 of FIG. 1, but which does not include material beyond that which is needed to engage and cover the pump housing 53, is shown. The use of the cover 115 will probably be accompanied by other attachement and support structure for the housing 53, such as by bolting or the use of a bracket. Such a bracket may engaged the fittings adjacent the upper and lower openings 55 and 69.

The present invention may be used in any setting in which a volume and pressure matched vacuum pump is to be utilized, and especially where the amount of expelled gasses and magnitude of vacuum is to be matched with rotational speed. Multiple variations on this invention are certainly possible, since variations can occur with any one or any combination of the components of several of the integrated structures, over various engine types, various magnitudes of air volume to be moved, and various magnitudes of vacuum to be achieved.

Modifications to all parts of the invention may occur to those skilled in the art, and those modifications may be produced without departing from the spirit and scope of the invention. Therefore, included within the patent warranted hereon are all such changes and modifications as may reasonably and properly be included within the scope of this contribution to the art.

What is claimed:

1. A vacuum pump comprising:

a pump housing having a generally annularly cylindrical shaped rear pump housing portion having a front opening and a rear wall, and having a smooth inner cylindrically shaped surface having a concentric center, a first flow opening and a second flow opening in alignment with said concentric center along a centerline, and a front support cover having a first portion sealably engageable over said front opening of said generally annularly cylindrical shaped rear pump housing portion, and a second portion extending from said first portion and having a radivsed slot to facilitate pivotably adjustable mounting to a support surface to facilitate belt drive;

a shaft extending from within said pump housing through an aperture and outside said pump housing, said shaft offset from and spaced apart from said concentric center perpindicular to said centerline;

a wiper member support mounted on said shaft and within said pump housing and carrying a plurality of wiper members for performing a sealed sweeping of said smooth inner surface for providing variable volume space of a first magnitude between adjacent ones of said plurality of wiper members adjacent said first flow opening and for providing a variable volume space of a second magnitude between said adjacent ones of said plurality of wiper members adjacent said second flow opening to provide a pumping action upon turning of said wiper member support and sealed sweeping of said smooth inner surface of said pump housing.

2. The vacuum pump recited in claim 1 wherein said second portion of said front support cover contains a bore spaced apart from said radiused slot to facilitate mounting to said support surface.

3. The vacuum pump recited in claim 1 wherein said pump housing further includes a second aperture and an outwardly disposed chamfer surrounding said second aperture and a bearing support groove surrounding said chamfer and wherein said shaft has a first end extending through said second aperture and further comprising:

a bearing supported within said bearing support groove;

a sealing ring supported within said chamfer and sealingly engaging said shaft; and a cover attached to said pump housing to sealably enclose said first end of said shaft, said bearing and said sealing ring.

4. The vacuum pump recited in claim 1 and wherein said wiper member support includes a slot for slidably supporting each wiper member into and out of said slot.

5. The vacuum pump recited in claim 1 and wherein said a pump housing includes a shallow clearance pocket adjacent a flat area of said smooth inner surface and a location where said shaft extends from within said pump housing through said aperture to reduce frictional resistance between said wiper member and said flat area of said smooth inner surface of said housing.

6. The vacuum pump recited in claim 1 and wherein said wiper member support includes an outwardly disposed capacity pocket between at least two of said plurality of wiper members for increasing the volume capacity of said vacuum pump.

7. The vacuum pump recited in claim 1 and further comprising a drive wheel attached to said shaft outside said pump housing.

8. The vacuum pump recited in claim 1 and wherein said wiper members and said wiper member support are coextensive with respect to an axial direction of said shaft.

9. The vacuum pump recited in claim 1 and wherein said plurality of wiper members further comprise an odd number of wiper members.

10. The vacuum pump recited in claim 1 and wherein said plurality of wiper members further comprise an even number of wiper members.

11. The vacuum pump recited in claim 1 and further comprising a drive wheel attached to said shaft outside said front cover of said pump housing whereby said first portion of said front support cover rotatably supports said shaft between attachment of said drive wheel and said attachment of said a wiper member support.

12. The vacuum pump recited in claim 1 wherein said pump housing further includes an outwardly disposed chamfer surrounding said first aperture and a bearing support groove surrounding said chamfer and wherein said shaft has a first end and a second end extending through said first aperture and further comprising:

a bearing supported within said bearing support groove; and a sealing ring supported within said chamfer and sealably engaging said shaft.

13. The vacuum pump recited in claim 12 and wherein said pump housing further includes a main shaft seal, carried within said bearing support groove and sealingly engage said shaft.

14. A vacuum pump comprising:

a pump housing having a generally annularly cylindrical shaped rear pump housing portion having a front opening and a rear wall and having a smooth inner cylindrically shaped surface having a concentric center, a first flow opening and a second flow opening in alignment with said concentric center along a centerline, and a front support cover having a first portion having a front wall disposed toward said rear wall and sealably engageable over said front opening of said generally annularly cylindrical shaped rear pump housing portion, and a second portion extending from said first portion and having a radiused slot to facilitate pivotably adjustable mounting to a support surface to facilitate the use of a belt drive;

a shaft having a first end rotatably supported by said pump housing and a second end and extending from within said pump housing through an aperture, said aperture offset from and spaced apart from said concentric center perpindicular to said centerline, said shaft rotatably supported adjacent said aperture, and extending outside said pump housing to said second end;

a wiper member support mounted on said shaft and within said pump housing and having a plurality of wiper member slots extending the length of said wiper member support, each wiper member slot carrying a of wiper member for performing a sealed sweeping of said smooth inner surface for providing variable volume space of a first magnitude between adjacent ones of said wiper members adjacent said first flow opening and for providing a variable volume space of a second magnitude between said adjacent ones of said wiper members adjacent said second flow opening to provide a pumping action upon turning of said wiper member support and sealed sweeping of said smooth inner surface of said pump housing.

15. The vacuum pump recited in claim 14 wherein said front support cover further comprises a first shaft aperture having a first chamfer surrounding said first shaft aperture and a first bearing support groove surrounding said first chamfer and wherein said shaft second end extending out of said front support cover extending oppositely with respect to said front wall, said shaft first end extending out of said front support cover disposed in the direction of said front wall, and wherein said generally annularly cylindrical shaped rear pump housing rear wall includes a second shaft aperture having a second chamfer surrounding said second shaft aperture and a second bearing support groove surrounding said second chamfer and wherein said first end of said shaft extends through said second shaft aperture;

a first bearing supported within said first bearing support groove;

a second bearing supported within said second bearing support groove;

a first sealing ring supported within said first chamfer and sealably engaging said shaft; and a second sealing ring supported within said second chamfer and sealably engaging said shaft.

16. The vacuum pump recited in claim 15 and further comprising a cover attached to said pump housing to enclose said first end of said shaft, said first bearing and said first sealing ring.

* * * * *